US005829217A

United States Patent [19]

Colen

[11] Patent Number: 5,829,217

[45] Date of Patent: Nov. 3, 1998

[54] WALL CONSTRUCTION AND SPACER FOR USE THEREWITH

[76] Inventor: William J. Colen, 2116 N. Lancaster-Hutchins Rd., Lancaster, Tex. 75146

[21] Appl. No.: 786,632

[22] Filed: Jan. 21, 1997

[51] Int. Cl.[6] ..... E04B 2/06

[52] U.S. Cl. ..... 52/442; 52/285.4; 52/421; 52/438

[58] Field of Search ..... 52/285.1, 285.4, 52/306, 307, 308, 421, 442, 438

[56] References Cited

U.S. PATENT DOCUMENTS

| | | | |
|---|---|---|---|
| 581,940 | 5/1897 | Pelton . | |
| 783,470 | 2/1905 | Schreck . | |
| 840,111 | 1/1907 | Collins . | |
| 901,833 | 10/1908 | Rettig . | |
| 949,527 | 2/1910 | Ensminger et al. . | |
| 963,776 | 7/1910 | Kosack . | |
| 963,778 | 7/1910 | Kosack . | |
| 1,052,670 | 2/1913 | Francis . | |
| 1,451,144 | 4/1923 | Decker . | |
| 1,503,931 | 8/1924 | Wightman . | |
| 1,558,247 | 10/1925 | Decker . | |
| 1,610,398 | 12/1926 | Tinker . | |
| 1,639,594 | 8/1927 | Decker . | |
| 1,968,393 | 7/1934 | Henderson . | |
| 1,982,560 | 11/1934 | Williams . | |
| 1,997,092 | 4/1935 | Duffy . | |
| 2,043,706 | 6/1936 | Myers . | |
| 2,172,816 | 9/1939 | Douglas et al. . | |
| 2,181,698 | 11/1939 | Langenberg | 52/421 X |
| 2,543,716 | 2/1951 | Carini . | |
| 2,748,593 | 6/1956 | Stetter . | |
| 3,170,267 | 2/1965 | Rosenfeld . | |
| 3,696,576 | 10/1972 | de Barros . | |
| 4,062,159 | 12/1977 | Pahr . | |
| 4,091,587 | 5/1978 | Depka | 52/421 |
| 4,244,155 | 1/1981 | Swiger | 52/442 |
| 4,696,140 | 9/1987 | Marshall . | |
| 4,774,793 | 10/1988 | Mayer . | |
| 5,056,289 | 10/1991 | Colen . | |
| 5,072,556 | 12/1991 | Egenhoefer | 52/421 X |
| 5,159,795 | 11/1992 | Colen . | |
| 5,231,815 | 8/1993 | Colen | 52/714 X |
| 5,351,457 | 10/1994 | Colen | 52/438 |
| 5,596,857 | 1/1997 | Besche | 52/421 |

FOREIGN PATENT DOCUMENTS

| | | |
|---|---|---|
| 523781 | of 0000 | Australia . |
| 365699 | of 0000 | Austria . |
| 320589 | of 0000 | Germany . |
| 2220430 | of 0000 | United Kingdom . |

*Primary Examiner*—Carl D. Friedman
*Assistant Examiner*—Timothy B. Kang
*Attorney, Agent, or Firm*—David H. Judson

[57] ABSTRACT

A spacer for use in the wall construction for a building or the like. The wall generally comprises a plurality of blocks arranged in at least first and second layers spaced one above the other by a predetermined distance, each block having first and second sides, an exterior face, and interior face, a top and a bottom, and a pair of cutouts extending through the block between the top and bottom. The tops of adjacent blocks in each layer are adapted to be located in a common plane. According to the preferred embodiment, the spacer comprises: a base including a medial portion, first and second opposed ends and a pair of opposed edges, at least one planar body attached to the medial portion of the base along an opposed edge thereof and extending perpendicularly upwards from the base, the planar body having a first and second tabs at opposed ends and first and second V-shaped supports located at and extending transversely from the first and second opposed ends of the base, respectively.

4 Claims, 5 Drawing Sheets

FIG. 1
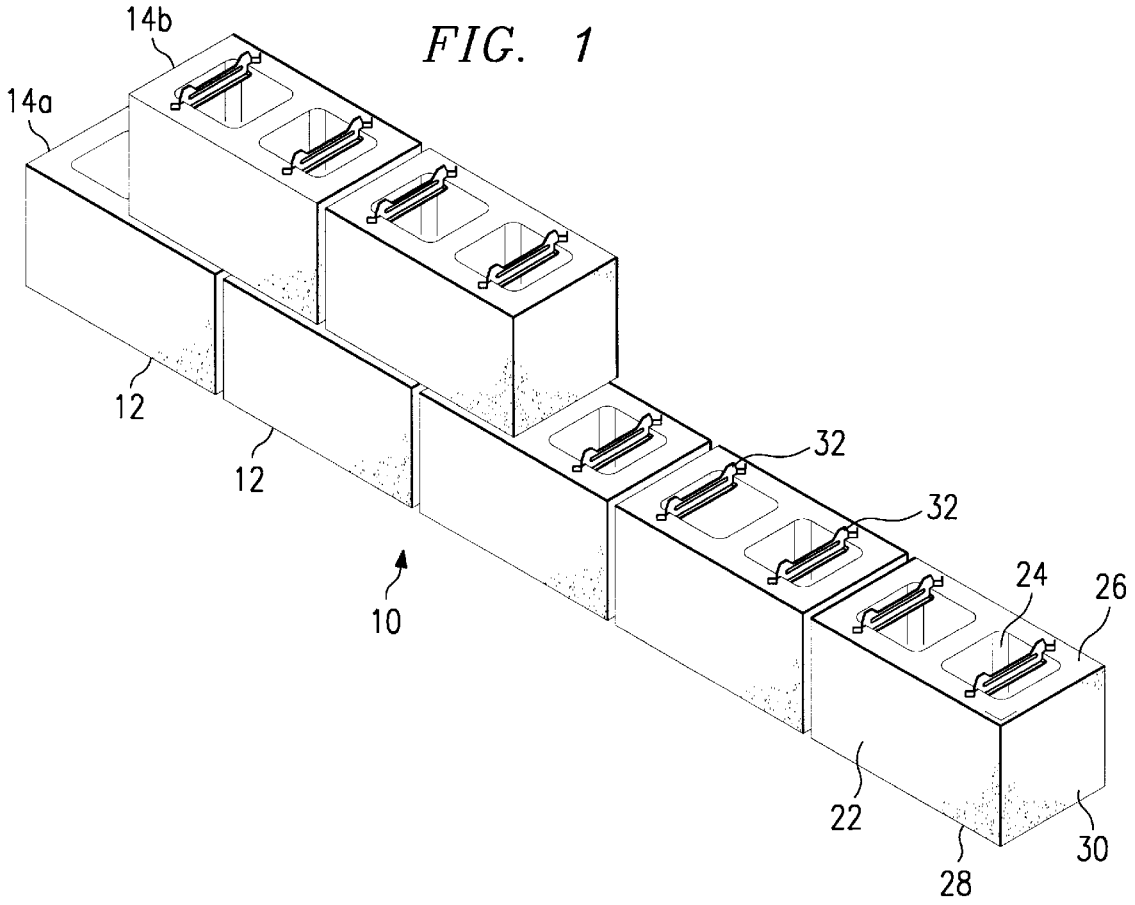
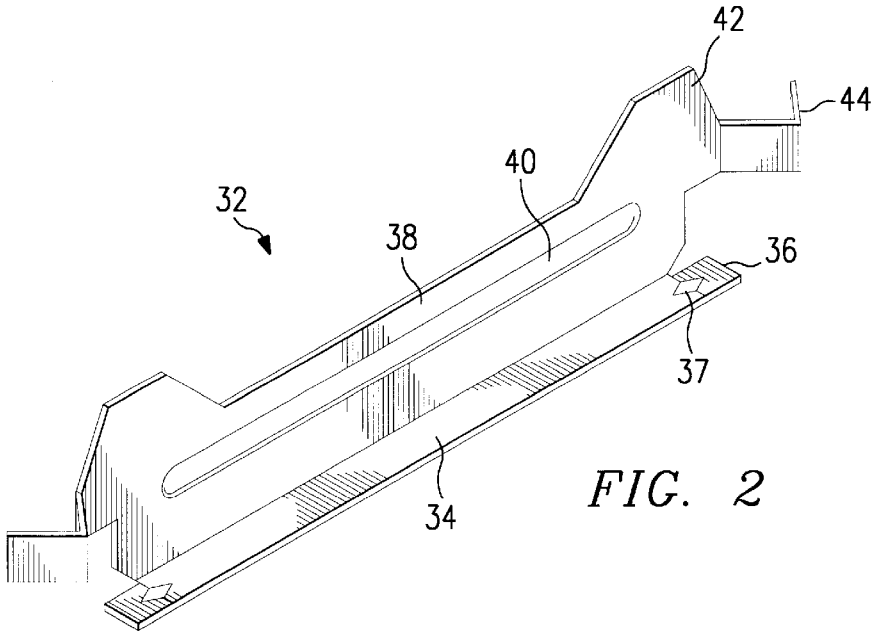
FIG. 2

WALL CONSTRUCTION AND SPACER FOR USE THEREWITH

TECHNICAL FIELD

The present invention relates generally to construction of cinder, clay or concrete block walls and more particularly to a novel spacer for use in such construction to facilitate correct alignment of the blocks even by unskilled laborers.

BACKGROUND OF THE INVENTION

Masonry construction techniques are well-known in the art. Such techniques, however, are impractical for many building projects due to the high cost of labor and materials. Additionally, because mortar must be applied by hand to each brick and the brick must be properly aligned with the bricks already in place, a high degree of skill is required to provide an aesthetically-pleasing result. Such results are extremely difficult to achieve with unskilled labor.

There have been attempts in the prior art to provide systems for assisting a laborer to properly align the bricks of a wall construction. Such systems are described in U.S. Pat. Nos. 2,172,816 and 3,170,267 to Douglas et al and Rosenfeld, respectively. In Douglas et al. for example, a plurality of T-shaped dowel plates are supported in aligned grooves along at least three edges of each brick. Rosenfeld describes a system wherein rod-like members are provided for vertical alignment with cross bars between such members for horizontal alignment.

While such systems do provide improvements over manual techniques for aligning bricks in a wall construction, they do not adequately solve the problems associated with the use of unskilled labor. Moreover, the complexity of such systems make them difficult to use in practice and are often more expensive than the cost of labor and materials. Such systems also do not reliably stabilize the bricks against lateral movement.

There is therefore a need to provide an improved wall construction technique that overcomes these and other problems associated with the prior art.

BRIEF SUMMARY OF THE INVENTION

It is an object of the present invention to provide a method for constructing a cinder or concrete block wall using unskilled labor.

It is yet another object of the present invention to describe a method for constructing a block wall that utilizes a plurality of inexpensive yet reliable alignment spacers.

It is a further object of the invention to provide a novel spacer construction for use by unskilled laborers in the construction of a block wall.

It is yet a further object of the present invention to describe a block wall construction comprising a plurality of blocks arranged in layers one above the other, and a plurality of simple-to-use spacers to aid in the construction of the wall.

It is another object of the invention to provide a block wall construction technique that is simple to implement and results in significant labor cost savings over prior art techniques.

These and other objects of the invention are provided in a spacer for use in the wall construction for a building or the like. The wall generally comprises a plurality of blocks arranged in at least first and second layers spaced one above the other by a predetermined distance, each block having first and second sides, an exterior face, and interior face, a top and a bottom, and a pair of cutouts extending through the block between the top and bottom. The tops of adjacent blocks in each layer are adapted to be located in a common plane. According to the preferred embodiment, the spacer comprises: a base including a medial portion, first and second opposed ends and a pair of opposed edges, at least one planar body attached to the medial portion of the base along an opposed edge thereof and extending perpendicularly upwards from the base, the planar body having a first and second tabs at opposed ends and first and second V-shaped supports located at and extending transversely from the first and second opposed ends of the base, respectively.

In use the base fits within the cutout of a block. The V-shaped supports protruding from the first and second tabs support the spacer on top of the block with the first and second tabs acting as guides and fitting into the cutout of the block placed on top as part of the next layer. Besides providing the necessary support for the base, the V-shaped supports also provide an indicator for the level of mortar to be applied on top of the block.

Thus according to the invention, when the spacer is used the distal ends of the legs do not extend beyond the interior and exterior faces of the blocks and therefore the spacer is not visible when the mortar joints are filled.

The foregoing has outlined some of the more pertinent objects of the present invention. These objects should be construed to be merely illustrative of some of the more prominent features and applications of the invention. Many other beneficial results can be attained by applying the disclosed invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which:

FIG. 1 is a perspective view of a brick wall construction wherein a plurality of spacers are used to facilitate alignment of the bricks by laborers;

FIG. 2 is perspective view of the spacer;

Similar reference characters refer to similar parts throughout the several views of the drawings.

DETAILED DESCRIPTION

Figure 3A:
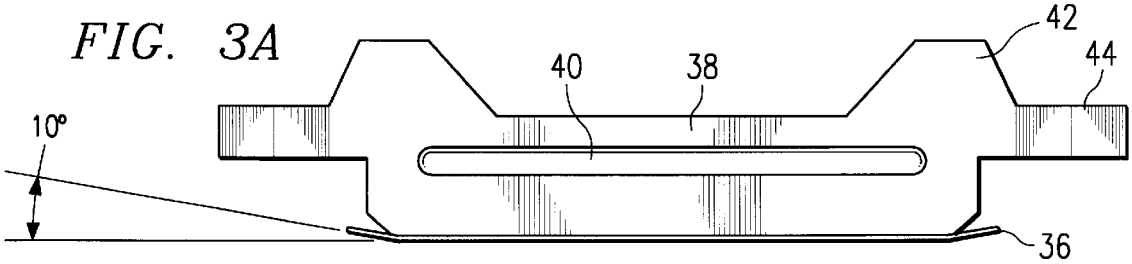
FIG. 3A is elevation view of the spacer.
Figure 3B:
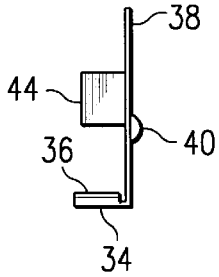
FIG. 3B is an end view of the spacer.
Figure 3C:
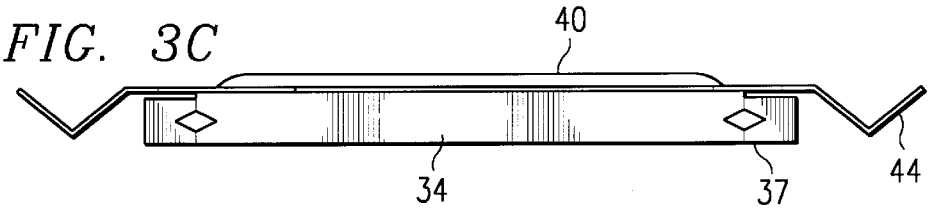
FIG. 3C is a top view of the spacer.

Referring now to FIG. 1, a novel wall construction 10 is shown. The wall comprises a plurality of blocks 12 arranged in layers 14*a*–14*b* one above the other, each of the blocks having an exterior face 22, a cut-out 24, a top 26, a bottom 28 and sides 30. Each of the blocks is preferably formed of cement, although the teachings are applicable to any wall constructing using blocks of other materials. As seen in FIG. 1, the cut-outs 24 are aligned with the cutouts of the next layer. While the use of cut-outs, it should also be appreciated that each block can alternatively incorporate other types of alignment means. A plurality of spacers 32 are arranged between adjacent blocks for the purpose of facilitating the proper alignment of the blocks during construction of the wall.

Referring simultaneously to FIGS. 2, 3A, 3B, 3C, 4A and 4B, each of the spacers is preferably formed in a flat profile and includes a base 34 having in the preferred embodiment raised opposing ends 36 integrally-formed therein wherein the ends will be stiffened by stamped diamonds 37. One edge will have a planar body 38 which is bendable into a perpendicular orientation relative to the base 34. The planar body may have a stiffening rib 40 to help its structural integrity. On either end of the planar body are raised tabs 42 which at their midpoints have preferably V-shaped support arms 44 that extend outwards. Such support arms 44 are used to rest the spacer on top of the cut-out of the block as depicted in FIG. 1. The support arm 44 has a predetermined height equal to the desired height (approximately ⅜ths of an inch) (see 44 in FIG. 4) of the mortar joint between successive layers 14*a*–14*b* of the brick wall.

Referring to FIGS. 1 and 2, in operation, the spacer 32 is fitted within the cut-out 24 of a block such that each of the support arms 44 rests on the block. The support arms 44 provide a spacing indicator for the addition of mortar. The next layer of blocks is added such that the tabs 42 of the spacer fit into the bottom 28 portion of the cut-out 24 of the block. This structure can be easily constructed by the laborer at the jobsite.

The spacer of FIG. 2 is preferably formed of steel, lightweight aluminum or other metals. Suitable other materials include impact resistant cardboard, composites or rigid plastics. It is simple and inexpensive to manufacture and provides a reliable tool for assisting even unskilled laborers to construct a brick wall. The spacer is designed to remain in the wall upon use. Each spacer is lightweight and can be easily transported to the jobsite and stored for subsequent use. Moreover, the use of the support arms as described above is especially advantageous because it facilitates the removal of excess mortar in the mortar joint when the overlying brick is placed on the spacer. The block will rest upon the support arm and squeeze out the excess mortar which can then be easily removed by the laborer.

Figure 5:
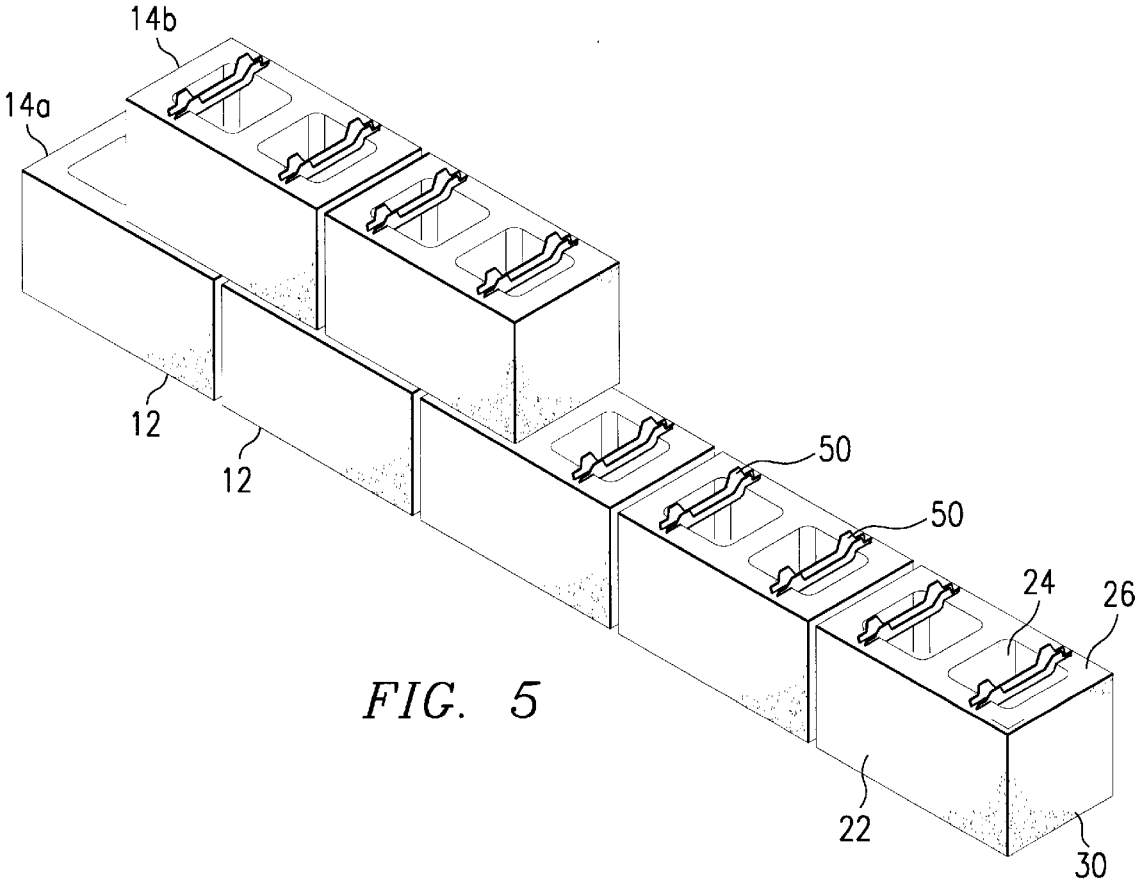
FIG. 5 is a perspective view of still another type of wall construction using an alternative type of spacer.
Figure 6:
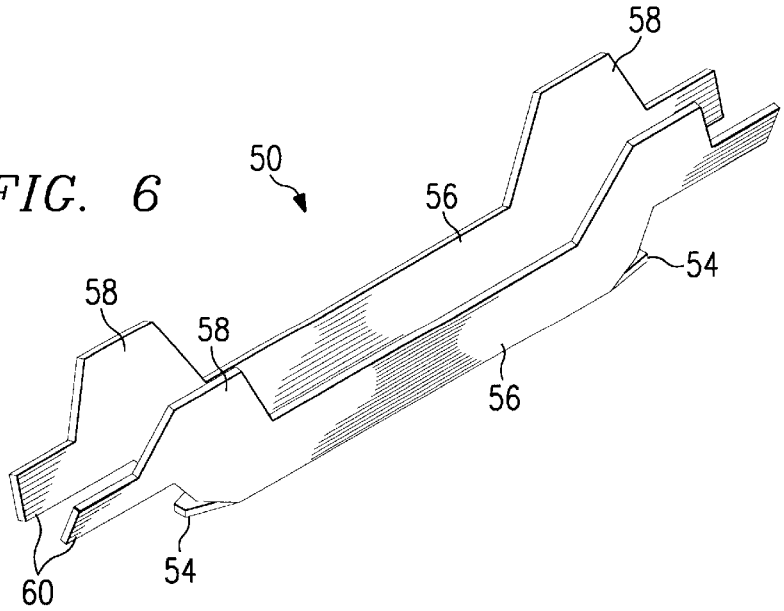
FIG. 6 is a perspective view of the alternative spacer.
Figure 7A:
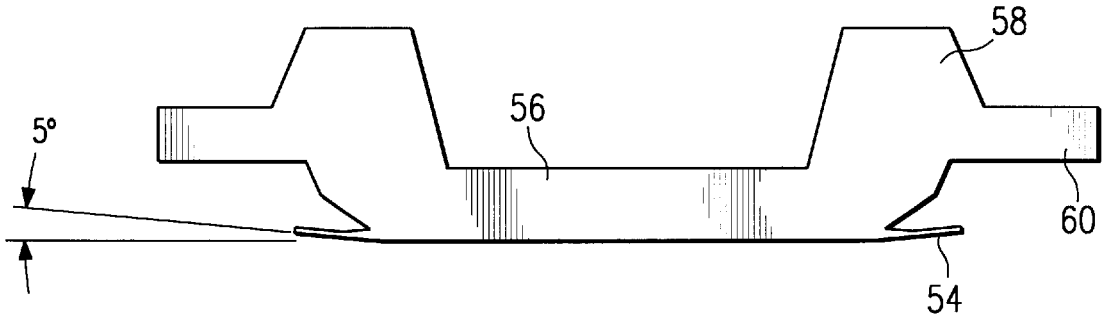
FIG. 7A is an elevation view of the spacer in FIG. 6.
Figure 7B:
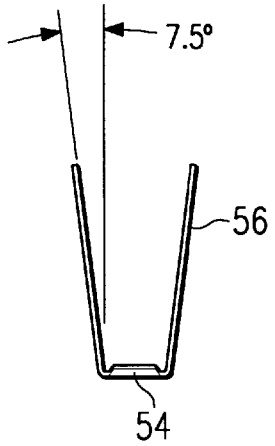
FIG. 7B is a end view of the spacer in FIG. 6.
Figure 7C:
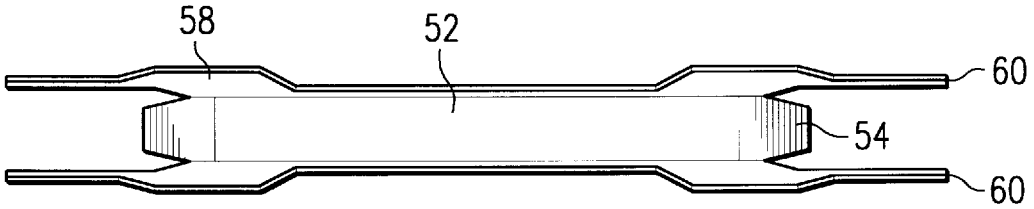
FIG. 7C is a top view of the spacer in FIG. 6.

Referring now to FIGS. 5 and 6, an alternate spacer construction is shown for use in the construction of a wall comprising a plurality of blocks arranged in at least first and second layers spaced one above the other by a predetermined distance. As previously described with respect to FIG. 1, each of the blocks having an exterior face 22, a cut-out 24, a top 26, a bottom 28 and sides 30. Referring to FIGS. 6, 7A, 7B, 8A and 8B, the spacer 50 includes a base 52 with slanting opposed ends 54. Two nearly perpendicular planar bodies 56 arise out of each edge of the base 52. Each planar wall has a tab 58 at opposite ends with a supporting arm 60 protruding from the center of the tab 58. The four supporting arms 60 rest upon the blocks as seen in FIG. 5 in order to support the spacer as well as provide an indicator for the level of mortar to be applied to the block. In this way, a mortar joint is created between the first and second layers of the wall.

According to the invention, when the spacer is used, the supporting arms of the spacer do not extend beyond the outer faces of the blocks and therefore the spacer is not visible when the mortar joints are filled. Further, although not shown in detail, it should be appreciated that cement material is used to fill the mortar joints before or after the placement of the spacer on the wall. Of course, the spacer is placed prior to hardening of the cement material. Use of the spacers in the manner disclosed herein significantly reduces mortar requirements and helps to maintain the structural stability of the wall while the cement hardens.

Figure 4A:
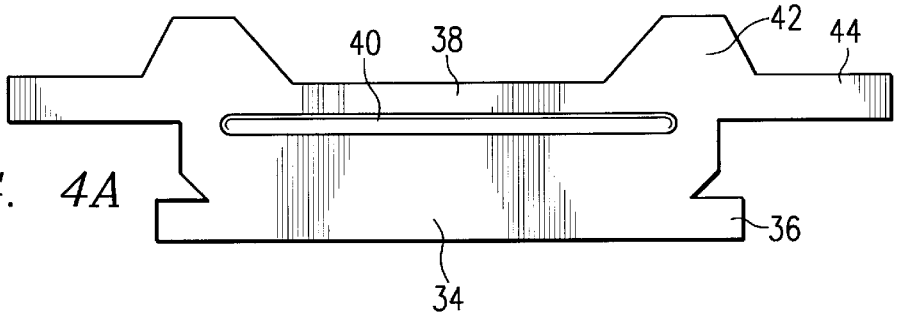
FIG. 4A illustrates the dimensions of the spacer.
Figure 4B:
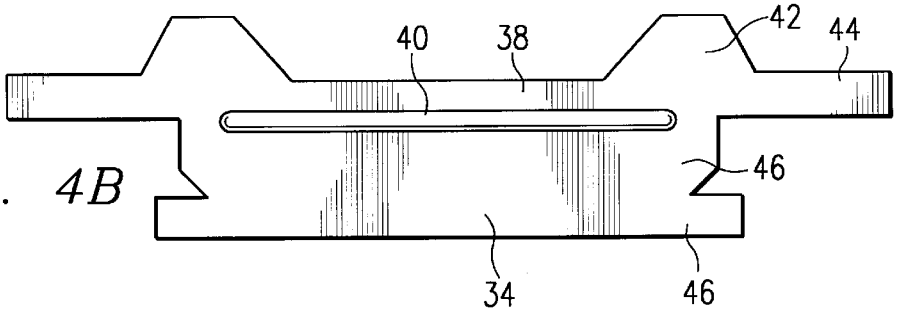
FIG. 4B illustrates additional dimensions of the spacer and includes fold lines.
Figure 8A:
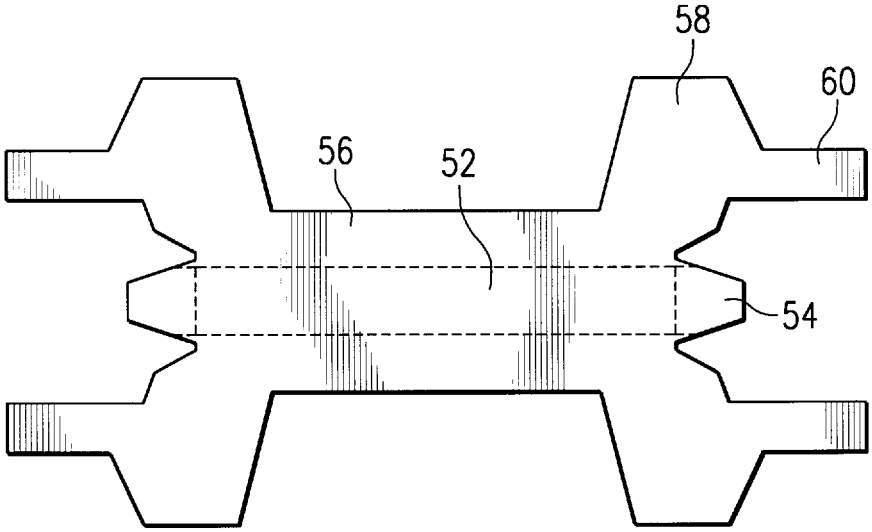
FIG. 8A illustrates the dimensions of the spacer of FIG. 6.
Figure 8B:
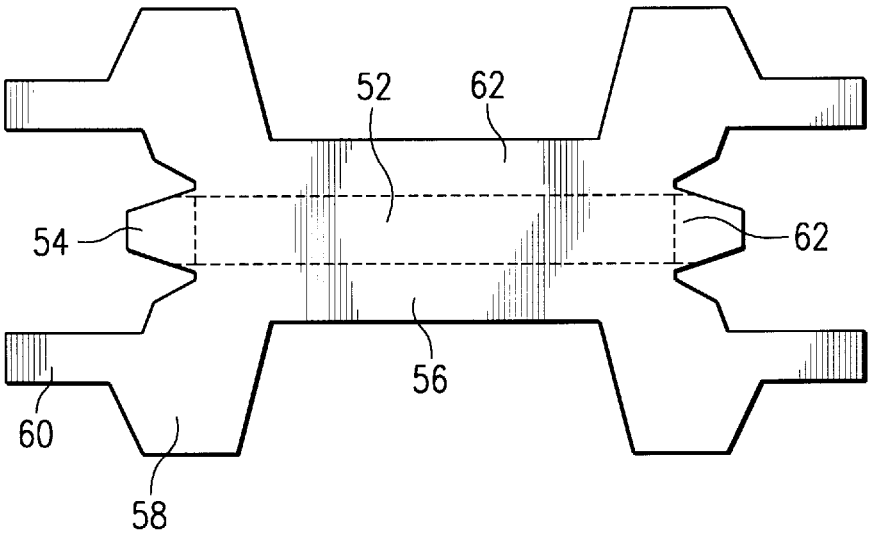
FIG. 8B illustrates the dimensions of the spacer of FIG. 6.

The spacer construction of FIGS. 4 and 8 are advantageous because the spacer is formed from a piece of flattened gauge aluminum or the like. For example, and with reference to FIGS. 4B and 8B, the spacer may be formed from a sheet of aluminum and includes the various component parts described above. Appropriate crimp or fold lines 46 and 62 may be used to facilitate the bending of the spacing tabs and the supports at the job site. Typically, however, the spacer can be delivered to the site with the tabs and supports pre-bent.

Preferably, the material used to form the spacer is not so rigid as to prevent the worker from conforming the supports to the precise geometry of the block. Thus some supports may need to be bent more than others, or some legs may be at slightly different angles than other legs depending on the physical characteristics of the block cutouts or other surfaces.

Although not shown, the spacers may be stacked in a nested manner for ease of transport because the angle between the medial portion and the base for the alternative spacer is greater than 90 degrees.

It should be appreciated by those skilled in the art that the specific embodiments disclosed above may be readily utilized as a basis for modifying or designing other structures for carrying out the same purposes of the present invention.

What is claimed is:

1. A spacer, used in the construction of a wall comprising a plurality of blocks arranged in at least first and second layers spaced one above the other by a predetermined distance, each block having first and second sides, a front having an outer face, a back having an outer face, a top and a bottom, and at least one cutout extending through the block between the top and bottom, wherein the tops of adjacent blocks in each layer are adapted to be located in a common plane and each block is adapted to be separated from an adjacent block in the layer by a predetermined distance, said spacer comprising:

a base fittable into the cut-out portion of the block, the base including first and second opposed ends and a pair of opposed longitudinal edges;

at least one planar body attached to the base along an opposed longitudinal edge thereof and extended at an upward angle from the base;

at least two opposed tabs extending further upwards from each planar body; and first and second support arms located at and extending from the first and second opposed tabs of the planar body, respectively;

wherein the support arms are capable of resting on the block to provide a mortar joint between the block and next layers of blocks;

wherein the opposed tabs are capable of extending into the cutout of the next block layer.

2. The spacer as described in claim 1 wherein, when the spacer is used, the support arms are located within planes defined by the outer faces of the blocks such that the spacer is not visible when the mortar joints are filled.

3. The spacer as described in claim 1 further including one or more stiffening ribs.

4. The spacer as described in claim 1 wherein the support arms are shaped in a V in the horizontal plane.

* * * * *